United States Patent [19]

Schirneker

[11] Patent Number: 4,557,687

[45] Date of Patent: Dec. 10, 1985

[54] FUEL ELEMENT AND FIREPLACE CONSTRUCTIONS USING SAME

[76] Inventor: Hans-Ludwig Schirneker, Engelslit 10, D-4773 Möhnesee-Völlinghausen, Fed. Rep. of Germany

[21] Appl. No.: 480,668

[22] Filed: Mar. 31, 1983

[30] Foreign Application Priority Data

Mar. 31, 1982 [DE] Fed. Rep. of Germany ..... 3211834

[51] Int. Cl.[4] ..... F23D 3/16

[52] U.S. Cl. ..... 431/291; 431/295; 431/303; 431/313; 431/325; 126/96; 362/209

[58] Field of Search ..... 431/291, 295, 296, 288, 431/289, 125, 312, 313, 324, 310, 311, 298, 323, 303, 302, 314, 322, 325; 126/127, 208, 255, 116 R, 96; 362/161, 209, 234

[56] References Cited

U.S. PATENT DOCUMENTS

| | | | |
|---|---|---|---|
| 36,694 | 10/1862 | Alden | 431/312 |
| 119,249 | 9/1871 | Thompson | 126/96 |
| 150,824 | 5/1874 | Buzby | 431/313 |
| 307,847 | 11/1884 | Dietz | 431/324 X |
| 419,040 | 1/1890 | Goldstein et al. | 126/96 X |
| 650,307 | 5/1900 | Darby | 431/303 |
| 722,988 | 3/1903 | Jeavons | 431/325 |
| 1,344,446 | 12/1917 | Engman | 431/291 |
| 1,403,010 | 1/1922 | Chadwick | 431/303 |
| 1,584,492 | 5/1926 | Taylor | 431/310 X |
| 2,080,251 | 5/1937 | Buskard | 431/291 X |
| 2,371,006 | 3/1945 | Weaver | 431/325 |
| 2,532,570 | 12/1950 | Meyer | 431/313 |
| 4,076,490 | 2/1978 | Hilker | 431/295 X |

*Primary Examiner*—Randall L. Green

*Attorney, Agent, or Firm*—Schwartz, Jeffery, Schwaab, Mack, Blumenthal & Evans

[57] ABSTRACT

A fuel element for open burning installations, such as a fireplace, containing a shell-like, elongated housing, in which a supply of fuel may be filled and refilled. In addition, at least one flat burner body, such as a flat wick, is arranged in the housing and immersed with its lower part in the fuel supply, while its upper edge is protruding in a height adjustable manner from the top side of the housing. A fireplace suitable for fuel elements of this type contains an exhaust hood in which is positioned a filter in the form of an absorber to purify and regenerate the air rising from the fuel elements, in particular removing suspended particles and eliminating unpleasant odors. The fireplace does not require outside connections.

7 Claims, 17 Drawing Figures

FIG.1
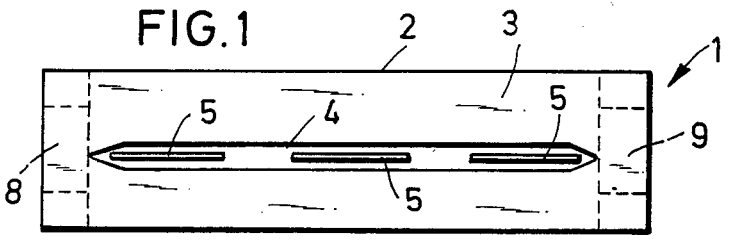
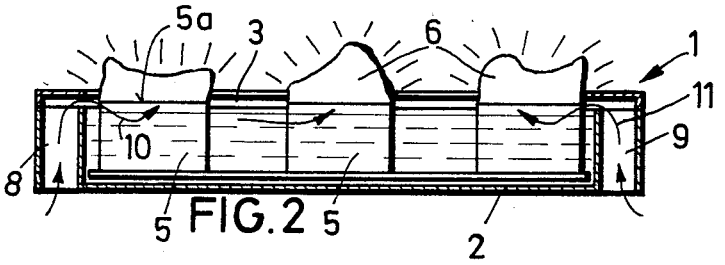
FIG.2
FIG.3
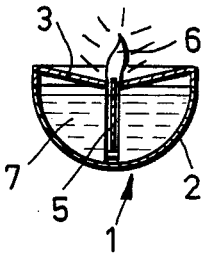
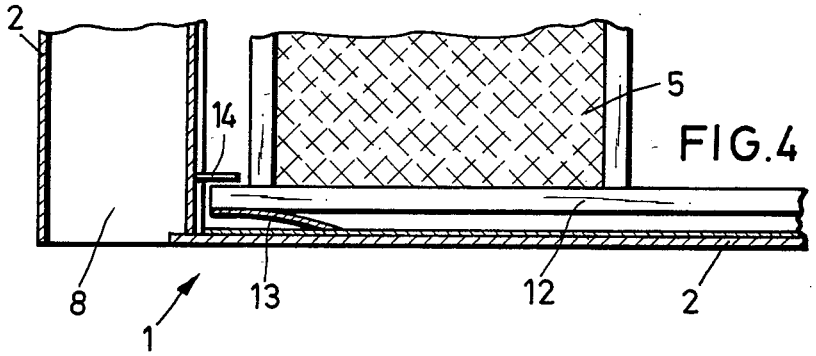
FIG.4
FIG.5
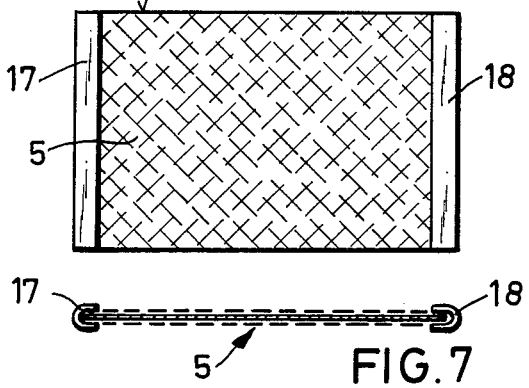
FIG.6
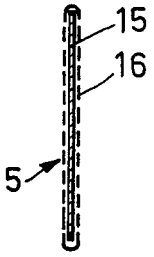
FIG.7

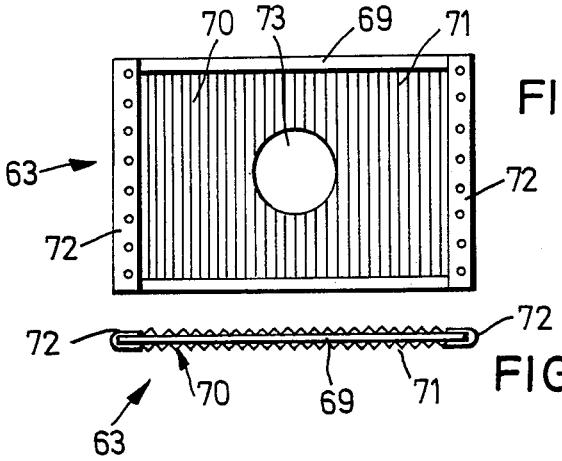
FIG.15
FIG.16
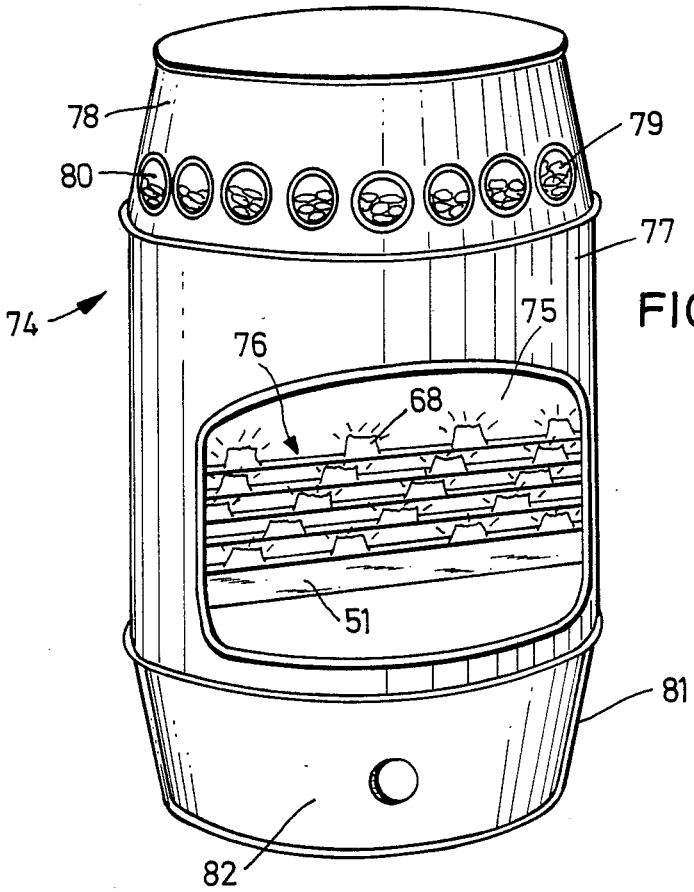
FIG.17

FUEL ELEMENT AND FIREPLACE CONSTRUCTIONS USING SAME

BACKGROUND OF THE INVENTION

The invention concerns a novel fuel element for open burning installations such as fireplaces. The invention further concerns a novel fireplace for fuel elements of this type.

Open burning installations such as fireplaces are generally heated with wood. The heat developed by the burning of wood requires fireplaces with relatively thick and thermally stable walls, and always access to a chimney. Furthermore, certain safety requlations must be observed.

It is, however, also known to simulate a burning fireplace by means of lighting effects obtained by electric lights. But the amenities of a fireplace, in particular the image of open flames, cannot be reproduced in this manner, although artificial fires of this type may have some justification in certain environments. In private homes, however, generally there is more emphasis on coziness. Open fireplaces frequently cannot be installed, however, because connection with a chimney is not possible and because the installation of a fireplace in a room of inadequate size may cause damage to furniture, carpets and floors by flying sparks.

SUMMARY OF THE INVENTION

It is the object of this invention to remedy this condition and to provide a fuel element for open burning installations, such as fireplaces, which while burning with an open flame do not develop the peak temperatures of burning logs of wood so that lighter and more simple fireplaces may be installed in smaller rooms, possibly not even requiring connection with a chimney.

To attain this object, according to the invention a fuel element in the shape of a burning log is proposed, which has a shell-like, elongated housing to receive a replenishable supply of a fuel, such as for example granulated paraffin, while on the top side of said housing a flat combustion body, such as a flat wick, is arranged. The lower end of the wick is located in the housing and is immersed in the fuel supply contained therein, with the upper edge or end of the flat wick protruding to the extent that an open flame is present. The invention therefore proposes as the fuel element a type of combustion body having at least one wick, saturated with a fuel, that is contained in an indestructable housing. The fuel may consist of solid combustibles, such as paraffin or liquid fuels such as oil. The housing may have the configuration of a split log of wood and be provided with a surface simulating the bark of wood. It is made for example of a metal and is thus indestructable.

According to the invention, a fireplace is further provided which consists of simple sheet metal parts and which is not required to include a flue for smoke gases, as the use of the fuel elements or fuel logs of the invention does not develop a high heat, and no smoke is generated.

The fuel element according to the invention is equipped with one or several wicks in the manner of a constant burner. The wicks, and in particular their material and their thickness, are chosen so that with consideration of the thermal conductivity of the material used, an adequate gasification temperature is always maintained for the fuel at the burning edge of the wick. If the fuel is paraffin or the like, the wicks must further conduct sufficient heat into the housing of the fuel element in order to melt the paraffin in the area of the immersed wicks, so that sufficient amounts of molten paraffin will always be drawn up into the wick. Thermal conductivity may be obtained, for example, by means of a piece of sheet metal embedded in the wick, and said sheet metal may contain openings to control the thermal conductivity.

The fuel element in the form of a simulated log of wood is constructed so that adequate air circulation is assured. Fresh air is supplied preferably from the ends of the fuel element to its surface, at the height of which the upper edge of the wick is located. This leads to a certain stabilization of the flames.

The fuel elements are appropriately arranged in a layer of several adjacent to each other, in order to convey the impression of a fireplace burning several logs of wood. The individual fuel elements are arranged at an adequate distance from each other, so that each element may be swept on all sides by air from the bottom. In this manner, relatively quiet flames are obtained.

The burning height of individual flames may be adjusted for example by means of an adjusting screw, which pushes the wick involved to a greater or lesser extent out of the cover of the fuel element housing. However, the wicks may also be supported on a beam, the position in height of which is lowered following the heating up of the fuel element and particularly of the fuel supply; this may be obtained by means of a bimetallic spring.

Instead of arranging several simple fuel elements adjacent to each other, a fuel element may contain wicks in several rows next to each other, with air gaps remaining open between them. The fuel supply may be located in this case in a common container.

The fuel element according to the invention, especially when it contains wicks in several adjacent rows, may further be used for cooking in a fireplace or as a camping burner, as the flame temperature is entirely adequate for cooking purposes. The wicks may be arranged in this case so that they correspond to the circular bottom surface of a pot.

It is possible according to the invention to produce fireplaces with light structures, as there are no peak temperatures such as those encountered in the burning of wood. Rather, uniform temperatures are assured. The upper part of the fireplace may be connected with an outlet or a chimney, but this is not necessary. For example, an absorber may be located in the upper part of the fireplace containing activated charcoal or diatomaceous earth, or equipped with sheet metal coated with activated charcoal. A filter of this kind is capable of adequately purifying the air rising from the fuel elements according to the invention so that air circulation within a closed room without access to outside air or to a chimney is possible.

The absorber may further contain pressed elements or granules of soda lime, which absorb or convert the carbon dioxide. These absorbers should have the largest possible surface area and therefore can be, for example, spherical.

The fireplace may have a configuration such that the air of the room passes through a double rear wall of the chimney for heating and does not enter into contact with the waste gases of the fuel elements. If the fireplace is not connected with a chimney or has no outlet to the outside, a heat utilization of practically 100% may be obtained.

A stand for a grill or to support a pot may be placed into the fireplace.

The individual fuel elements can be provided on the bottom thereof, with a pin that may be inserted in a support. For example, two parallel pieces can form a grate upon which several individual fuel elements are mounted for adjustment to a limited extent, so that they are not absolutely parallel to each other, but are slightly oblique, thereby creating the impression of randomly placed logs of wood.

BRIEF DESCRIPTION OF THE APPLICATION DRAWINGS

In the drawings, embodiments of the fuel element and fireplace according to the invention are shown. In the drawings:

FIG. 1 shows a top view of a first embodiment of the fuel element,

FIG. 2 is a longitudinal section of the fuel element in FIG. 1,

FIG. 3 is a cross section of the fuel element of FIGS. 1 and 2,

Figure 8:
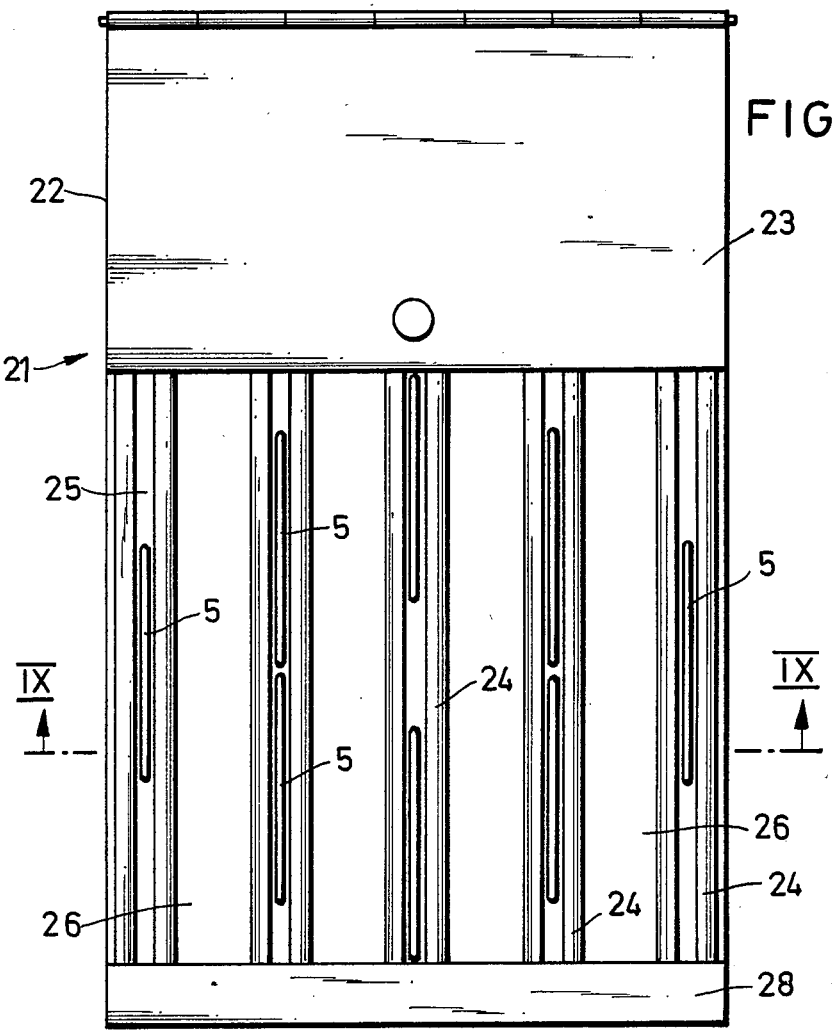
Figure 9:
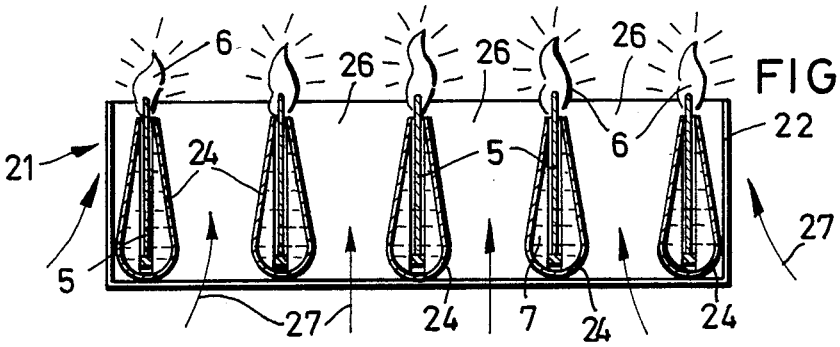
Figure 10:
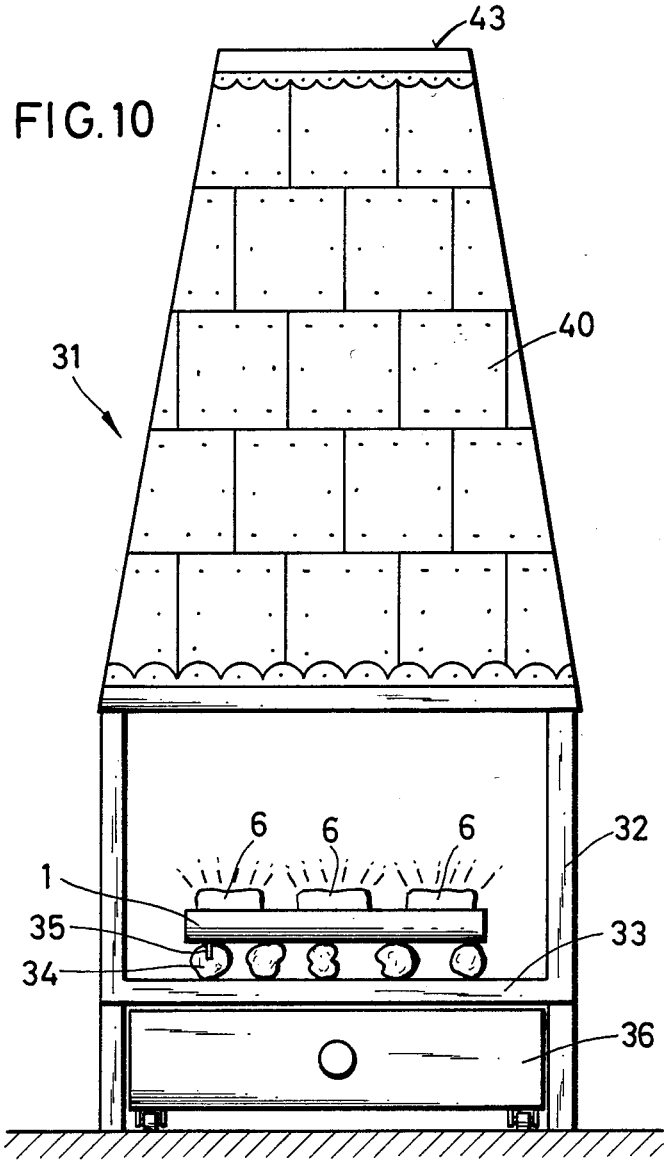
Figure 11:
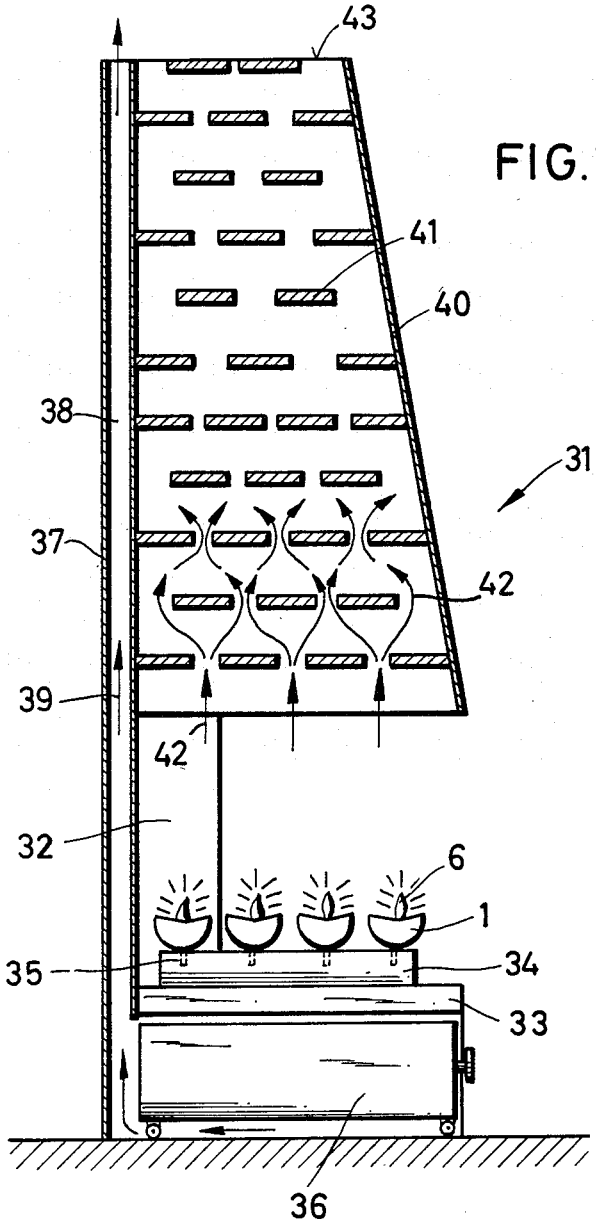
Figures 12, 13, 14:
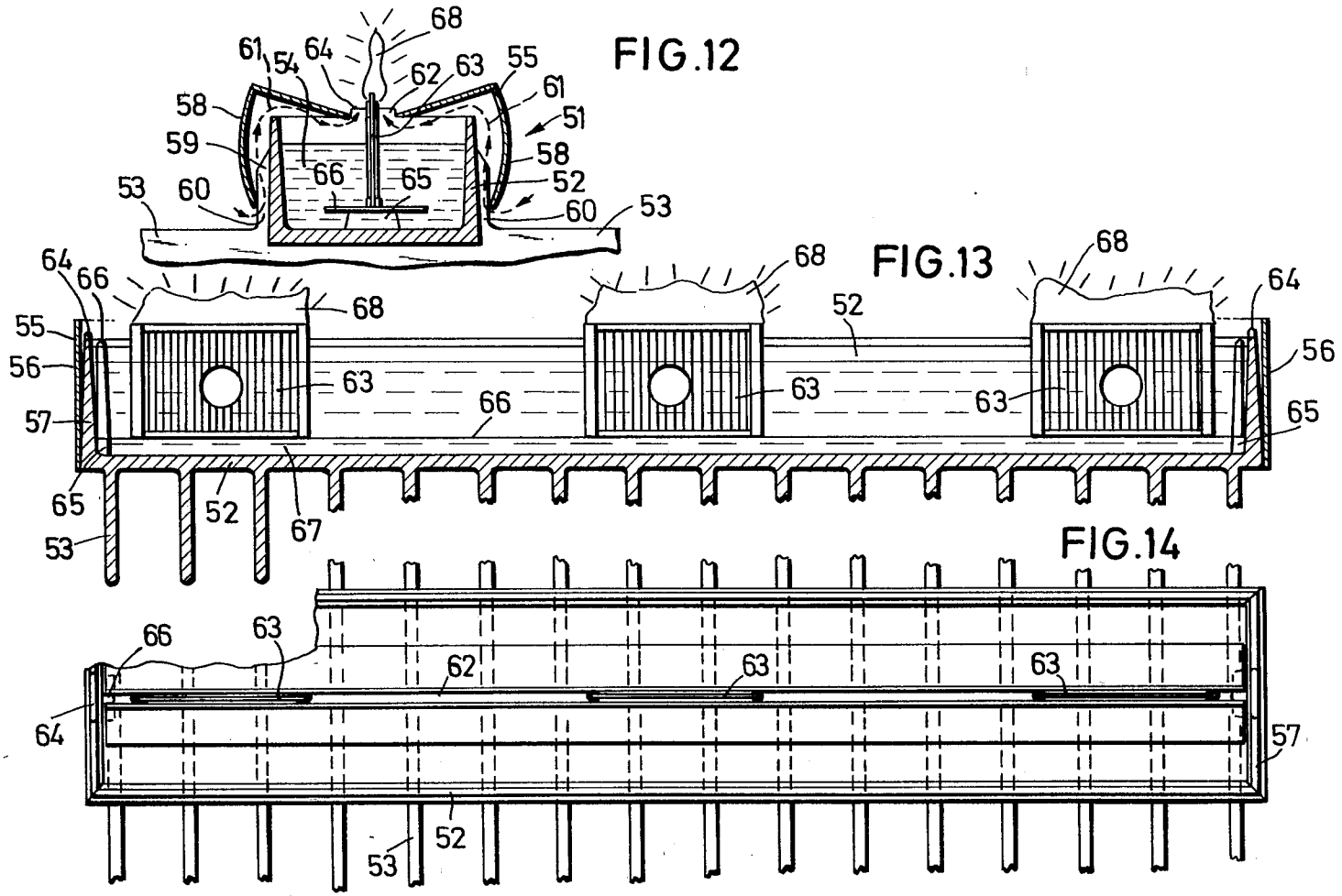

FIG. 4 is a detail of the fuel element of FIGS. 1 to 3, wherein the position of a flat wick may be seen, FIG. 5 is a side elevation of a flat wick to be used in a fuel element according to FIGS. 1 to 4, FIG. 6 is a front elevation of the flat wick of FIG. 5, FIG. 7 is a top view of the flat wick of FIGS. 5 and 6, FIG. 8 is a top view of a second embodiment of the fuel element, FIG. 9 is a cross section of the fuel element of FIG. 8, taken on the line IX—IX of FIG. 8, FIG. 10 is a front elevation of a fireplace for the fuel elements according to FIGS. 1 and 8, FIG. 11 is a vertical section through the fireplace of FIG. 10, FIG. 12 is a cross sectional view through a further fuel element embodiment of the invention;

FIG. 13 is a longitudinal sectional view of the embodiment of FIG. 12;

FIG. 14 is a top plan view of the embodiment of FIG. 12;

FIG. 15 is a front view of the flat wick which forms part of the fuel element of FIGS. 12–14;

FIG. 16 is a top plan view of the flat wick of FIG. 15, and

FIG. 17 is a further embodiment of a fireplace incorporating the fuel elements in accordance with the present invention.

DETAILED DESCRIPTION OF THE PREFERRED EMBODIMENTS

The fuel element 1 shown in FIGS. 1 to 4 has a metal housing 2, preferably with an approximately semicircular cross-sectional configuration. A removable cover 3 is set on the housing, the cover having a center slot 4 extending in the longitudinal direction, through which three flat wicks 5 protrude from the inside of the housing 2 to the top side of the cover 3. The upper edge 5*a* serving as the burning edge may protrude to different heights from the slit 4, in order to control the height of the flame 6. A form of embodiment suitable for this purpose is described in connection with FIG. 4.

The housing 2 contains a fuel supply 7 into which the wicks 5 are immersed. The fuel supply 7 may be replenished by removing the cover 3. Granular paraffin is used, for example, as the fuel.

Air shafts 8 and 9, leading from bottom to top, but covered by the cover 3, are provided at the ends of the housing 2, and through which fresh air flows to the flames 6, as shown by arrows 10 and 11. The fresh air therefore arrives in an approximately horizontal manner at the burning edge 5*a* of the individual wicks 5, so that the flames burn quietly and practically without flickering.

Both the housing 2 and the cover 3 may be formed of sheet metal. The wicks 5 are resting with their lower end on a beam 12, supported in the lower area of the housing 2 with limited height adjustability. The beam 12 is supported at both of its ends on bimetallic springs 13, which normally pressure the corresponding ends of the beam upward against tongues 14 extending laterally into the housing 2. If, however, the fuel supply 7 in the housing 2 has attained a certain elevated temperature, i.e. when it has melted, the bimetallic springs 13 are deformed so that they no longer pressure the beam 12 against the tongues 14 so that the beam 12 moves downwardly within the housing 2. Correspondingly, the upper burning edge 5*a* of each wick 5 is automatically lowered when a certain relatively lower temperature is reached, so that the flame 6 burns in a more stable manner and cannot flicker.

Each wick 5 consists essentially, as seen in FIGS. 5 to 7, of a metal plate 15 and a hose 16 of a glass wool fabric or other inorganic material, which does not burn, the hose 16 being drawn over the plate 15. The thickness of the sheet metal 15 is a function of the thermal conductivity of the material so that on the one hand an adequate gasification temperature is always maintained at the burning edge 5*a* of the wicks 5, and on the other, the wick is conducting sufficient heat to the inside in order to rapidly melt the fuel supply 7. The plate 15 may further contain a plurality of orifices to control the thermal conductivity. If the plate 15 consists of iron, it has a thickness, for example, of 0.1 to 0.2 mm.

At the ends of the wick 5, sheet metal fittings 17 and 18 are located, and serve to keep the hose 16 on the plate 15.

While the fuel element 1 shown in FIGS. 1 to 3 has wicks 5 in a single row, the wicks 5 in the embodiment according to FIGS. 8 and 9 are placed in several parallel rows, i.e. a total of five rows. This fuel element 21 has a container 22 for a supply of fuel, equipped with a pivoting cover 23, so that the fuel supply may be replenished at any time, even while the fuel elements are in operation. In this form of embodiment it is thus not necessary to extinguish the flames 6 in order to fill in more fuel.

Five channels 24 are connected with one side of the container 22, and each channel contains on its top side a longitudinal slit 25, through which one or more wicks 5 protrude to a greater or lesser extent. The wicks may be supported in a manner similar to that described in connection with FIG. 4. Between the individual channels 24 there is a free space 26 so that free air may circulate, as shown by arrows 27, to reach the individual flames from below. The flames 6 therefore burn in a very stable and quiet manner.

The channels 24 are filled with a supply 7 of fuel, which is being constantly replenished from the supply contained in the container 22.

The ends of the channels 24 facing the container 22 are connected with each other in the example shown by means of a transverse channel 28 in order to improve the equalization of liquid fuel, such as liquid paraffin, in the individual channels.

It will be seen in FIG. 8 that the wicks 5 are arranged offset with respect to each other so that they approximately form a circular surface of a size corresponding to the bottom surface of a cooking pot. The fuel element 21 thus may be further used for cooking, frying and the like.

In FIGS. 10 and 11 a fireplace 31 is shown, to be used in combination with the aforedescribed fuel elements and requiring no connection with a chimney. Even though the fireplace is of a light construction, the fuel elements do not develop excessive degrees of heat.

The fireplace 31 has a box-like hearth 32, on the bottom 33 of which is placed a grating formed by parallel pieces of wood 34 or similar objects which serve to support a row of fuel elements 1. As shown in FIG. 11, each of these fuel elements 1 is provided at its bottom end with a vertical pin 35, which is inserted in one of the pieces 34 of wood. The fuel element 1 may be rotated around this pin 35 so that while an adequate distance between adjacent fuel elements 1 is assured, they are not necessarily parallel to each other.

A displaceable box 36 is provided under the bottom 33 of the hearth 32, to serve, for example, for the storage of fuel.

The rear wall 37 of the chimney 31 has a double wall as shown in FIG. 11, so that it forms an air shaft 38, through which air may flow as shown by the arrow 39, from bottom to top, and heated in the process.

Over the hearth 32 a thin walled hood 40 is fastened, to which in several rows over each other and mutually offset, sheet metal pieces 41 coated with activated charcoal are fastened. The heated air rising from the individual fuel elements 1 and their flames 6 flows around these plates 41 as shown by arrows 42 in FIG. 11. The upper end of the hood 40 is at least partially open so that the air rising to the top of the hood 40 may escape from the hood, after sweeping over the plates 41 which form absorbers.

In FIGS. 12 to 14, a further embodiment of the fuel element is shown in transverse cross section, longitudinal cross section, and top view, respectively.

In this embodiment the fuel element 51 has a box like, elongated housing 52, rectangular in its cross section, cast of a metal, for example, aluminum, in a single piece together with the ribs 53 which form a grate. Even though in the drawing only one box-like housing 52 is shown, preferably several housings 52 are arranged adjacent to each other or possibly offset with respect to each other on the grate formed by the ribs 53 and may thus be set as a unit in a fireplace or removed from it as a unit. A fuel, such as paraffin 54, may be filled conveniently in the box-shaped housing 52.

Each housing 52 is equipped with a removable cover 55 which can be for example fabricated from sheet metal, for example, and which rests with its frontal ends 56 under an elastic prestress against the frontal walls 57 of the box-like housing 52. The cover 55 is thereby held in the desired position.

As shown in FIG. 12, the side walls 58 of the cover 55 abut against the spaced high ridges 59 of the ribs 53, so that between the side walls of each housing 52 and the cover 55, there are orifices 60, through which fresh air may flow, as indicated by the broken line arrows 61.

The cover 55 contains in its top side a slot 62 extending in the longitudinal direction, through which the flat wicks 63 protrude. At each of the end walls 57 of the housing 52 a high ridge 64 is located as a centering projection, against the side of which the longitudinal edges defining the slot 62 of the cover 55 are abutting, when the latter is placed in its operating position on the housing 52.

On the inner side of each of the walls 57 of each housing 52 a high shoulder 65 is located. The two shoulders 65 serve to support a holder 66 for the flat wicks 63. The flat wicks 63 are held in this embodiment of the fuel element at a certain distance 67 from the bottom of the housing 52, so that the heat generated by the flames 68 cannot impact directly the bottom and thus the wall of the housing 52, but only through the paraffin 54 filled into the housing.

In FIGS. 15 and 16, one of the flat wicks 63 is shown in a front and top view, respectively. This flat wick 63 has a core 69 consisting of hose-like woven or knit fabric, with a metal plate arranged in it, not shown. Around the core, a metal sleeve 70 is arranged, which, as shown in particular in FIG. 16, consists of two corrugated metal sheets, which correspondingly have vertical ribs 71 which are in line contact with the core 69, so that conduction of heat from the burning wick is not excessive. The two corrugated sheets of the sleeve 70 are connected with each other at their ends by the clamps 72 consisting of aluminum strips fastened to the core 69.

At approximately one half of its height and in the center of the sleeve 70 on each side a circular opening 73 is provided, which is important for the initial burning time of the wick 63, so that even during the first ten to fifteen minutes of burning time sufficient paraffin may arrive at the core 69 of the wick, thereby enabling the latter to burn correctly.

The core 69 of the flat wick 63 protrudes on top and bottom for a certain distance from the sleeve 70, with said distance corresponding to the distance of the burning height of the wick. The heat emanating from the flame 68 is conducted rapidly through the metal sleeve 70 downward and liquifies the paraffin 54 around the flat wick 63, so that the paraffin is able to rise on the core 69 and supply the flame 68 with an adequate amount of fuel.

The ribs 53 of the grate also serve the purpose of cooling, for which reason the radiating surface of the rib system should be in a correct proportion to the number of flames 68, so that the flames will not be too hot and thus excessively high. To ignite the wicks 63 and to refill paraffin 54, the grate is pulled out, together with the housings placed on it, from the fireplace and may then be reinserted in the combustion chamber of the fireplace.

FIG. 17 shows perspectively a chimney-less fireplace 74, in the combustion chamber of which is arranged a grate 76 consisting of the fuel elements 51 and the ribs 53 connecting them. The fireplace has a cylindrical housing 77 with a cover-like lid 78, in which a filter of a porous rock 79 is arranged, visible through lateral orifices 80. The foot 81 is equipped with a drawer 82 in which paraffin may be stored for refilling.

FIG. 17 shows the combustion chamber 75 open to the front. It is, however, also possible to provide the opening with a door, not shown, for example of a transparent material.

I claim:

1. A fuel element for open burning facilities such as fireplaces, comprising:

(a) an elongated, box-like housing having bottom, side and end walls, and open at its top;

(b) a replenishable supply of solid fuel in said housing, said fuel being solid at normal temperatures and adapted to melt during use of the element;

(c) a removable cover positioned to close the top of the housing, said cover being formed with a longitudinally extending slot, and (d) at least one wick means positioned in said housing and extending through said slot, said wick means comprising a core surrounded by corrugated metallic plates which function to dissipate the heat conducted therethrough when the core is burning, said core when ignited burning said fuel to form a flame above said cover in the vicinity of said slot, wherein said core has a metal plate arranged in it, which plate is formed with a generally central opening to facilitate movement of the fuel to the upper portion of the core during initial burning.

2. The fuel element of claim 1 wherein said core is of knit or woven fabric.

3. The fuel element of claim 1 wherein said cover includes side walls spaced from the adjacent side walls of said housing by spaced ridges formed on said housing side walls, the space between said ridges forming openings through which fresh air can flow to said wick means to facilitate combustion.

4. The fuel element of claim 1 further including means for supporting said wick means above the bottom wall of said housing whereby heat generated by the burning of said wick means is conducted through said solid fuel to said housing bottom wall.

5. The fuel element of claim 4 wherein said supporting means comprises shoulders formed on the end walls of the housing, and a holder positioned on said shoulders and directly supporting said wick means in spaced relation from the bottom of the housing.

6. The fuel element of claim 1 wherein three wick means are positioned in said housing in longitudinally spaced locations.

7. The fuel element of claim 1 in which a centering ridge is formed on the interior of each end wall of said housing, said ridge being dimensioned to receive said slot formed in said cover so as to center said cover on said housing.

* * * * *